US011944186B2

(12) United States Patent
Burns et al.

(10) Patent No.: US 11,944,186 B2
(45) Date of Patent: Apr. 2, 2024

(54) FLEXIBLE CLEANER

(71) Applicant: Burns Brothers LLC, Minneapolis, MN (US)

(72) Inventors: Eli Burns, Minneapolis, MN (US); Noah Burns, Minneapolis, MN (US); Luke Burns, Minneapolis, MN (US)

(73) Assignee: BURNS BROTHERS LLC, Minneapolis, MN (US)

( * ) Notice: Subject to any disclaimer, the term of this patent is extended or adjusted under 35 U.S.C. 154(b) by 152 days.

(21) Appl. No.: 17/694,217

(22) Filed: Mar. 14, 2022

(65) Prior Publication Data

US 2022/0287446 A1 Sep. 15, 2022

Related U.S. Application Data

(60) Provisional application No. 63/160,320, filed on Mar. 12, 2021.

(51) Int. Cl.

| | |
|---|---|
| ***A46B 11/00*** | (2006.01) |
| ***A46B 5/00*** | (2006.01) |
| ***A46B 9/00*** | (2006.01) |
| ***A46B 15/00*** | (2006.01) |
| ***A47L 17/04*** | (2006.01) |

(52) U.S. Cl.

CPC ..... *A46B 11/002* (2013.01); *A46B 5/0095* (2013.01); *A46B 9/005* (2013.01); *A46B 11/0062* (2013.01); *A46B 15/0081* (2013.01); *A47L 17/04* (2013.01); *A46B 2200/3033* (2013.01)

(58) Field of Classification Search

CPC . A46B 11/002; A46B 11/0062; A46B 5/0095; A46B 9/005; A46B 2200/3033

See application file for complete search history.

(56) References Cited

U.S. PATENT DOCUMENTS 2,772,430 A 12/1956 Moritt
3,187,365 A 6/1965 Tadeusz
(Continued)

FOREIGN PATENT DOCUMENTS

CA 2682632 A1 10/2008
CN 205233798 U 5/2016
(Continued)

OTHER PUBLICATIONS

ANVIX, Soap Dispensing Palm Brush, https://www.amazon.com/ANVIX-Dispensing-Kitchen-Scrubber-Bristles/dp/8081S81PD7, accessed Jun. 3, 2022.

(Continued)

*Primary Examiner* — Natasha N Campbell
(74) *Attorney, Agent, or Firm* — GRUMBLES LAW PLLC; Bryan Kravis

(57) ABSTRACT

A flexible cleaning device which may include a handle assembly and a cleaning head connected thereto. The handle assembly may include a reservoir which may be in fluidic communication with the cleaning head that consists of a non-porous material. Within the cleaning head a emulsion cavity may be disposed that is in fluidic communication with both the reservoir and an area exterior to the cleaning head. And a method for using such a flexible cleaning device to remove dirt and debris from unclean surfaces.

20 Claims, 8 Drawing Sheets

(56) References Cited

U.S. PATENT DOCUMENTS

| | | | | |
|---|---|---|---|---|
| 4,004,854 | A | 1/1977 | Breer | |
| 4,618,279 | A | 10/1986 | Gurevich et al. | |
| 5,094,558 | A | 3/1992 | Chu | |
| 5,114,256 | A | 5/1992 | Lin | |
| 5,452,961 | A | 9/1995 | Lu | |
| 5,890,829 | A | 4/1999 | Hesse | |
| 5,988,911 | A | 11/1999 | Browne, Jr. et al. | |
| 6,086,278 | A | 7/2000 | Keller | |
| 6,210,064 | B1 | 4/2001 | White et al. | |
| 6,319,332 | B1 | 11/2001 | Gavney, Jr. et al. | |
| 6,623,201 | B2 | 9/2003 | Brumlik | |
| 7,040,830 | B2 | 5/2006 | Kliegman et al. | |
| 7,357,587 | B2 | 4/2008 | D'Angelo | |
| 7,461,993 | B1 | 12/2008 | Sampaio | |
| 7,484,260 | B2 | 2/2009 | Jaffe | |
| 7,682,097 | B2 | 3/2010 | Knopow et al. | |
| 7,716,775 | B2 | 5/2010 | DiPietro et al. | |
| 7,966,688 | B2 | 6/2011 | Tsutanaga et al. | |
| 8,083,860 | B2 | 12/2011 | Loftis | |
| 8,152,929 | B1 | 4/2012 | Perring | |
| 8,475,070 | B1 | 7/2013 | Miner et al. | |
| D690,481 | S | 9/2013 | Roehm et al. | |
| 8,601,631 | B1 | 12/2013 | Martin | |
| 8,678,693 | B2 | 3/2014 | Sturgis et al. | |
| 8,763,616 | B2 | 7/2014 | Koptis et al. | |
| 8,955,189 | B2 | 2/2015 | Schouten | |
| 9,138,121 | B2 | 9/2015 | Baarsch et al. | |
| 9,211,756 | B2 | 12/2015 | Ballot | |
| 9,326,642 | B1 | 5/2016 | Williams | |
| 9,326,655 | B2 | 5/2016 | Call | |
| 9,339,104 | B2 | 5/2016 | O'Neill | |
| 9,408,521 | B2 | 8/2016 | Molinet et al. | |
| 9,526,326 | B2 | 12/2016 | Neumann et al. | |
| 9,556,407 | B2 | 1/2017 | Darrow | |
| 9,694,380 | B2 | 7/2017 | Byrne et al. | |
| 9,901,165 | B2 | 2/2018 | Sampaio | |
| 9,901,166 | B2 | 2/2018 | Fifield | |
| 9,968,181 | B2 | 5/2018 | Nomura-Rodgers | |
| 9,974,381 | B2 | 5/2018 | Shafer et al. | |
| 9,975,142 | B2 | 5/2018 | Hwang et al. | |
| 10,092,932 | B2 | 10/2018 | Oster | |
| 10,285,567 | B2 | 5/2019 | Krause et al. | |
| 10,292,561 | B2 | 5/2019 | Gonzales et al. | |
| 10,307,032 | B2 | 6/2019 | Alstad | |
| 10,357,406 | B2 | 7/2019 | Addison et al. | |
| 10,469,026 | B2 | 11/2019 | Zanini et al. | |
| 10,638,831 | B2 | 5/2020 | Pilevsky et al. | |
| 11,096,551 | B2 | 8/2021 | Chaffee et al. | |
| 2004/0105715 | A1* | 6/2004 | Spelman | A47L 17/04 401/6 |
| 2005/0260028 | A1 | 11/2005 | Gu | |
| 2007/0223989 | A1 | 9/2007 | Bizzotto | |
| 2015/0096595 | A1* | 4/2015 | Klimis | A47K 7/03 15/244.4 |
| 2017/0119227 | A1 | 5/2017 | Chaffee | |
| 2017/0181596 | A1 | 6/2017 | Daveloose et al. | |
| 2020/0196831 | A1 | 6/2020 | Renner et al. | |

FOREIGN PATENT DOCUMENTS

| | | | |
|---|---|---|---|
| JP | 2008056348 | A | 3/2008 |
| JP | 2016013435 | A | 1/2016 |
| KR | 101144144 | B1 | 5/2012 |
| WO | 2003082048 | A1 | 10/2003 |

OTHER PUBLICATIONS

Butler Home Products Dawn Palm Scrubber, https://www.amazon.com/Butler-Home-Products-DAWN-SCRUBBER/dp/B01FKGC9MU, accessed Jun. 3, 2022.

Casabella Palm Scrubber, https://www.amazon.ca/Casabella-Palm-Scrubber-Black-White/dp/B07CCK4VWP, accessed Jun. 3, 2022.

Cuisinart Silicone Cleaning Brush—Long Handle Scrub Brush with Built-in Food Scraper, https://www.amazon.in/Cuisinart-Silicone-Cleaning-Brush-Built/dp/B083KPPX27, accessed May 23, 2022.

Every Market, Silicone Sponge Scrubber, https://everymarket.com/products/silicone-sponge-scrubber-2-pack-3-in1-multi-functional-scraper-for-kitchen-and-bathroom-cleaning-built-in-soap-dispenser, accessed Jun. 3, 2022.

Full Circle, Suds Up Soap Dispensing Dish Brush with Bamboo Handle, https://www.amazon.com/Full-Circle-Soap-Dispensing-Bamboo-Handle/dp/B0086FDC74?th=1, accessed Jun. 3, 2022.

Fyeme, Kitchen Dish Brush Set, https://www.walmart.com/ip/seort/562941189, accessed Jun. 3, 2022.

GIR, Silicone Basting Brush, https://www.gir.co/products/basting-brush/?variant=31226389954649, accessed Jun. 3, 2022.

Joseph Joseph, 85159 CleanTech Dish Brush and Reusable Sponge Scrubber Set, https://www.amazon.com/Joseph-CleanTech-Reusable-Scrubber-Quick-Dry/dp/B07YLGSWBP, accessed Jun. 3, 2022.

KitchenAid, Soap Dispensing Sink Brush, https://www.amazon.com/KitchenAid-Soap-Dispensing-Brush-Black/dp/B07R9GS2B3?th=1, accessed Jun. 3, 2022.

Kitchiny, Silicone Bottle Brush, https://www.amazon.com/Silicone-Bottle-Cleaning-Brush-Antibacterial/dp/B07CLDNYWH?th=1, accessed Jun. 3, 2022.

Kuhn Rikon, 3-n-1 Scrubber, https://www.crateandbarrel.com/kuhn-rikon-red-3-in-1-scrubber/s516488?localedetail=US&a=1552&campaignid=10461646755&adgroupid=103999389299&targeti%E2%80%A6, accessed Jun. 3, 2022.

Libman, Soap Dispenser with Brush, https://www.amazon.com/Libman-Soap-Dispenser-W-Brush/dp/B017A0Y9R2/ref=asc_df_B017A0Y9R2/?tag=hyprod-20&linkCode=df0&hvadid=241942285135&%E2%80%A6, accessed Jun. 3, 2022.

Liflicon, Silicone Scrubber Sponges, https://www.amazon.com/Liflicon-Silicone-Scrubber-Sponges-Kitchen-Bathroom/dp/B083K5CNWS?th=1, accessed Jun. 3, 2022.

Lola Products, Soap Dispensing Dish Wand, https://www.amazon.com/Products-Dispensing-Absorbent-Non-Stick-Non-Scratch/dp/B08WHZ4CCT, accessed Jun. 3, 2022.

Lysol, 2-in-1 Dish Wand, https://www.walmart.com/ip/Lysol-2-IN-1-Dish-Wand-1-0-OZ/52144903, accessed Jun. 3, 2022.

Martha Stewart, Soap Dispensing Palm Brush, https://www.macys.com/shop/product/martha-stewart-collection-soap-dispensing-palm-brush-created-for-macys?ID=8326942, accessed Jun. 3, 2022.

O-Cedar, Scrunge Multi-Use Scrub Sponge, https://www.walmart.com/ip/O-Cedar-Scrunge-Multi-Use-Scrub-Sponge-All-Purpose-Non-Scratch-Sponge-6-Ct/861798359, accessed Jun. 3, 2022.

Outtills, Silicone Sponge, https://www.amazon.com/Outtills-Silicone-Sponge-Pack-Bonus/dp/B0785HQ25W, accessed Jun. 3, 2022.

OXO Good Grips, Soap Dispensing Brush, https://www.amazon.com/OXO-Good-Grips-Dispensing-Brush/dp/B000CC91GK, accessed Jun. 3, 2022.

Scotch-Brite, Advanced Soap Control Dishwand Brush Scrubber, https://www.amazon.com/Scotch-Brite-Advanced-Brush-Control-Dishwand/dp/B07LGVV4M8/ref=asc_df_B07LGVV4M8/?tag=hyprod-20&linkCode=df0&hvadi%E2%80%A6, accessed Jun. 6, 2022.

Scotch-Brite, Non-Scratch Dishwand, https://www.walmart.com/ip/Scotch-Brite-Non-Scratch-Dishwand-Soap-Dispensing-1-Count/810515987?wmlspartner=wlpa&selectedSellerId-0, accessed Jun. 3, 2022.

Scrub Daddy, Original Scratch Free FlexTexture Scrubbing Sponge, https://www.amazon.com/Scrub-Daddy-Scrubbing-Sponge-Original/dp/B074MB2V4B?th=1, accessed Jun. 3, 2022.

Scrub Daddy, Scrub Daisy Kit including Dishwand, https://smileshop.scrubdaddy.com/product/scrub-daisy-dishwand-system-complete-kit/, accessed Jun. 3, 2022.

SOIDHSID, Leakproof Hand-Held Dish Scrubber with Soap Dispenser Dish Wand, https://www.amazon.com/Leakproof-Hand-Held-Dispenser-Multipurpose-Replacement/dp/B0931QVNPF, accessed Jun. 3, 2022.

Sur La Table, Dual-Action Silicone Sponge, https://www.surlatable.com/sur-la-table-dual-action-silicone-sponge/PRO-3565876.html, accessed Jun. 3, 2022.

(56) References Cited

OTHER PUBLICATIONS

Windfall, Silicone Flex Toilet Brush with Holder, https://www.amazon.com/Revolutionary-Silicone-Cleaner-Flexible-Bristles/dp/B08VJ48L2K, accessed Jun. 3, 2022.

* cited by examiner

FLEXIBLE CLEANER

FIELD

This disclosure relates to scrubbing devices, particularly to such scrubbing devices that include a handle with a cleaning fluid reservoir and scrubber head comprised of multiple layers of flexible non-porous material.

BACKGROUND

Even with the enumerable variety of scrubbing devices available in the marketplace, there is always room for innovation due to the still existing unmet needs of the end-users.

SUMMARY

According to this disclosure, a flexible non-porous scrubber can be an effective cleaning apparatus when a handle assembly wherein the handles assembly includes an outer wall having a reservoir disposed therein; the reservoir may contain a liquid. A button may be disposed through and on the outer wall. The handles assembly may also include a dispensing port that is in fluidic communication with the reservoir. At one end of the handle assembly may be a footing disposed on the outer wall that may include a central depression which may define an upper and lower lip. A cleaning head may be connected to the lower lip of the footing, wherein the cleaning head may consist of a body having an upper portion, a lower portion, and a sidewall wherein the upper portion includes an opening that forms a rim that is structured and configured to fit around the central depression of the footing of the handle assembly. Within the cleaning head, an emulsion cavity may be disposed between the upper and lower portions. The emulsion cavity may be in fluidic communication with the reservoir via a dispensing port and may also be in fluidic communication with the exterior of the cleaning head via at least one aperture disposed in the cleaning head.

The flexible non-porous material of the cleaning head may include a variety of materials that consist of a group including silicone, rubber, synthetic polyisoprene, polyurethane, nitrile, natural latex rubber, and thermoplastic elastomers and polymers, or any combination thereof. The cleaning head may also include a scrubbing surface that is disposed on the lower portion of the body. The scrubbing surface may consist of at least one layer of scrubbing material. The scrubbing material may include a single material or a combination of materials from the group consisting of rottenstone, tripoli, whiting, pumice, volcanic ash, quartz, marble, feldspar, silica, steel wool, walnut shells, calcium carbonate, aluminum carbide, garnet, sand, iron oxide, emery, diamond dust, sandstone, staurolite, tungsten, corundum, silicon carbide, borazon, ceramic, ceramic aluminum oxide, ceramic iron oxide, aluminum oxide, glass powder, zirconia alumina, boron carbide, slags, and zirconium, thermoplastic polymers, copper, stainless steel.

The sidewall of the cleaning head may come in a variety of shapes and combinations of shapes such as convex, concave, convex polygons, concave polygons, and perpendicular with respect to the upper and lower portions of the cleaning head. The handle assembly may include a threaded end-cap that is disposed on one of its ends.

In some embodiments, the outer wall of the handle assembly may include an exterior surface coating of rubber or silicone.

In some embodiments of the cleaning head, the scrubbing surface may comprise a plurality of geometric formations disposed on the surface of the flexible non-porous material scrubbing surface. The scrubbing surface in some embodiments may be over-molded onto the lower portion of the cleaning head.

In some embodiments of the flexible cleaner, the dispensing port may include a one-way valve disposed between the dispensing port and the emulsion cavity.

In some embodiments of the flexible cleaner, the upper lip of the footing may include a scrubbing wedge, wherein the scrubbing wedge can be integral to the footing and consist of the same material or consist of a different material. The material of the scrubbing wedge may be non-flexible.

A method for using a flexible cleaner can include supplying a flexible cleaning device comprising a handle assembly wherein the handles assembly includes an outer wall having a reservoir disposed therein, the reservoir may contain a liquid. A button may be disposed through and on the outer wall. The handles assembly may also include a dispensing port that is in fluidic communication with the reservoir. At one end of the handle assembly may be a footing disposed on the outer wall that may include a central depression which may define an upper and lower lip. A cleaning head may be connected to the lower lip of the footing, wherein the cleaning head may consist of a body having an upper portion, a lower portion, and a sidewall wherein the upper portion includes an opening that forms a rim that is structured and configured to fit around the central depression of the footing of the handle assembly. Within the cleaning head an emulsion cavity may be disposed between the upper and lower portions. The emulsion cavity may be in fluidic communication with the reservoir via a dispensing port and may also be in fluidic communication with the exterior of the cleaning head via at least one aperture disposed in the cleaning head.

Filling the reservoir with a miscible cleaning fluid then forcing the miscible cleaning fluid through the dispensing port by having a user depress the button into the emulsion cavity. The cleaning head can then be introduced into a source of water and compressed by the end-user to allow the water to flow into the emulsion cavity through the aperture. The user compression can create an emulsion within the emulsion cavity with the miscible cleaning fluid and the water. Subsequently, the emulsion may be released onto an unclean surface and then dispensed while applying pressure with the cleaning head, dispensing the emulsion and then scrubbing the unclean surface until clean. The method may also include the steps of removing the cleaning head from the footing and then subjecting the cleaning head to a sanitizer as well as manually clearing the device of any organic/foreign debris that may have been within the confines of the cleaning head.

The method may also include a cleaning head non-porous material to be selected from the group consisting of silicone, rubber, synthetic polyisoprene, polyurethane, nitrile, natural latex rubber, and thermoplastic elastomers and polymers, or any combination thereof. The cleaning head may also include a scrubbing surface that is disposed onto the lower portion of the body, the scrubbing surface having at least one layer of scrubbing material.

The method may also include a cleaning head body with a sidewall having a shape, with respect to the upper portion and lower portion of the body, is selected from the group consisting of convex, concave, convex polygons, concave polygons, and perpendicular or any combination thereof. The flexible cleaning device may further comprise an end-cap disposed on one end of the handle assembly. And may further include a dispensing port having a one-way valve, wherein the one-way valve is in fluidic communication with the emulsion cavity and the reservoir.

The above summary is not intended to describe each and every example or every implementation of the disclosure. The description that follows more particularly exemplifies various illustrative embodiments

BRIEF DESCRIPTION OF THE DRAWINGS

The following description should be read with reference to the drawings. The drawings, which are not necessarily to scale, depict examples and are not intended to limit the scope of the disclosure. The disclosure may be more completely understood in consideration of the following description with respect to various examples in connection with the accompanying drawings.

DETAILED DESCRIPTION

Figure 1:
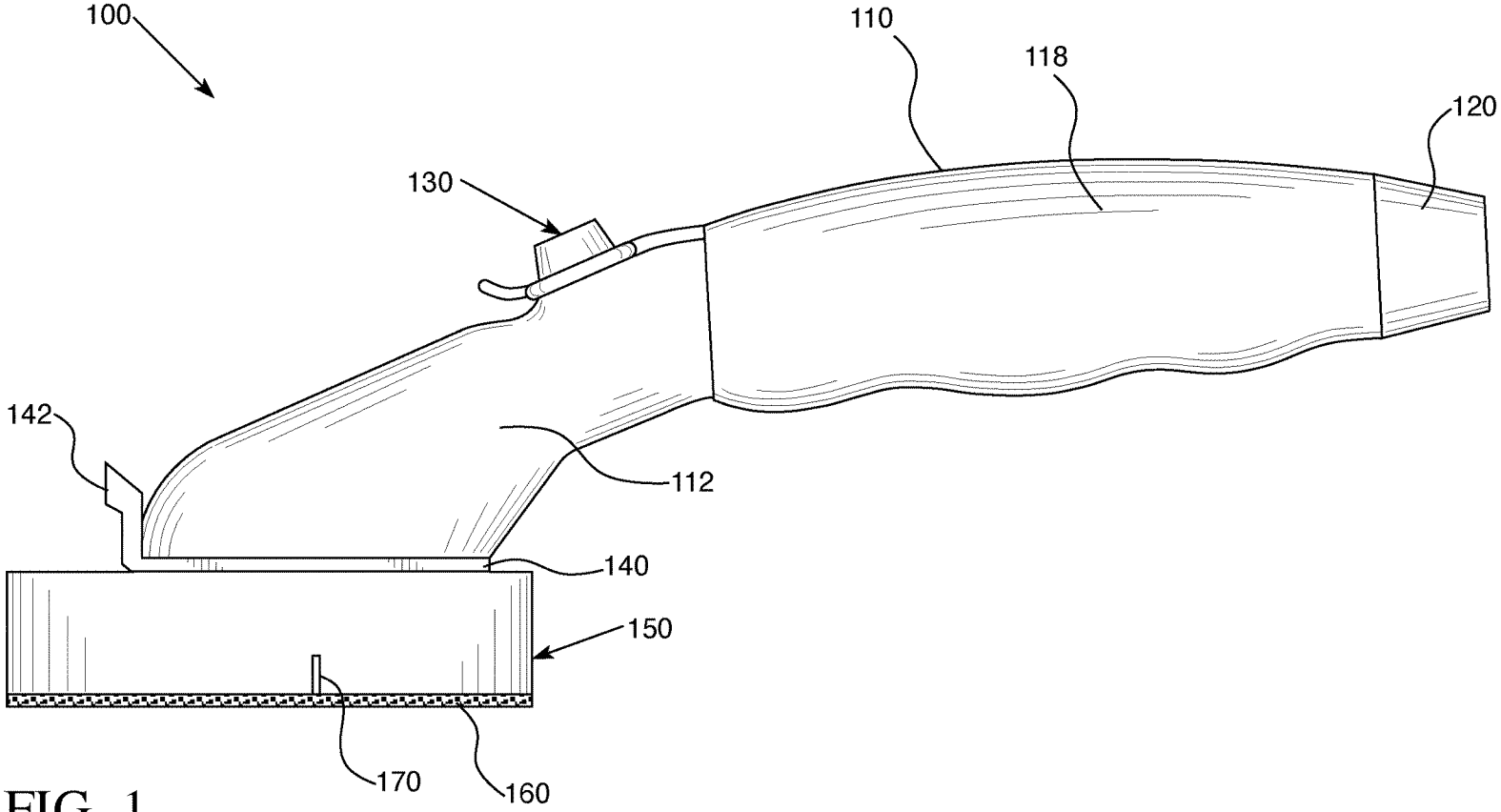
FIG. 1 is a left-side plan view of an embodiment of the current invention with a cleaning head secured to the footing.

The present disclosure relates to a flexible cleaner, and more particularly to such flexible cleaners that include a handle with a cleaning fluid reservoir and scrubber head comprised of multiple layers of non-porous material. Various embodiments are described in detail with reference to the drawings, in which like reference numerals may be used to represent like parts and assemblies throughout the several views. Reference to various embodiments does not limit the scope of the systems and methods disclosed herein. Examples of construction, dimensions, and materials may be illustrated for the various elements; those skilled in the art will recognize that many of the examples provided have suitable alternatives that may be utilized. Any examples set forth in this specification are not intended to be limiting and merely set forth some of the many possible embodiments for the systems and methods. It is understood that various omissions and substitutions of equivalents are contemplated as circumstances may suggest or render expedient. Still, these are intended to cover applications or embodiments without departing from the disclosure's spirit or scope. Also, it is to be understood that the phraseology and terminology used herein are for the purpose of description and should not be regarded as limiting.

The problem with sponges currently available is that they are constructed of porous materials with multitudes of areas within their pores that can allow for the build-up of stagnant water and debris. This stagnation within the pores of such sponges gives rise to the perfect breeding ground for bacteria, which is antithetical to the purpose of a cleaning device. Users of such porous sponges, after their first use, are no longer cleaning with that sponges as much as smearing the surface of the object they are handling with bacteria and debris.

A scrubbing device that is constructed of non-porous material does not suffer such an affliction. The nature of non-porous material prevents the absorption of fluids within their cleaning surfaces that can include fluids feted with bacteria. The use of such non-porous materials in a scrubbing device allows for such a device that can be used time and time again, even when the non-porous material is treated with harsh conditions to sanitize, such as with chemicals and heat or any combination thereof. The non-porous material may consist of any material that is flexible, capable of being chemically bonded into multiple layers, is able to withstand repeated applications of chemical sanitizers, and temperatures ranging from about 120° F. to about 200° F.; such materials may include silicone, rubber, synthetic polyisoprene, polyurethane, nitrile, natural latex rubber, and thermoplastic elastomers and polymers or any combination thereof. Such scrubbing device may include an interior emulsification area where water may be combined with a cleaning fluid for assistance in any cleaning carried out with the scrubbing device.

In FIG. 1, an embodiment of a flexible cleaner 100 of the current disclosure is illustrated where a handle assembly 110 may have a cleaning head 150 connected to the proximal end of the handle assembly 110 via a footing 140 disposed on the proximal end of handle assembly 110. The footing 110 may be integral to the handle assembly 110 in some embodiments; other embodiments may include a footing 140 as a separate structure that has been adhered to the handle assembly 110 via methods commonly known in the art.

Figure 2:
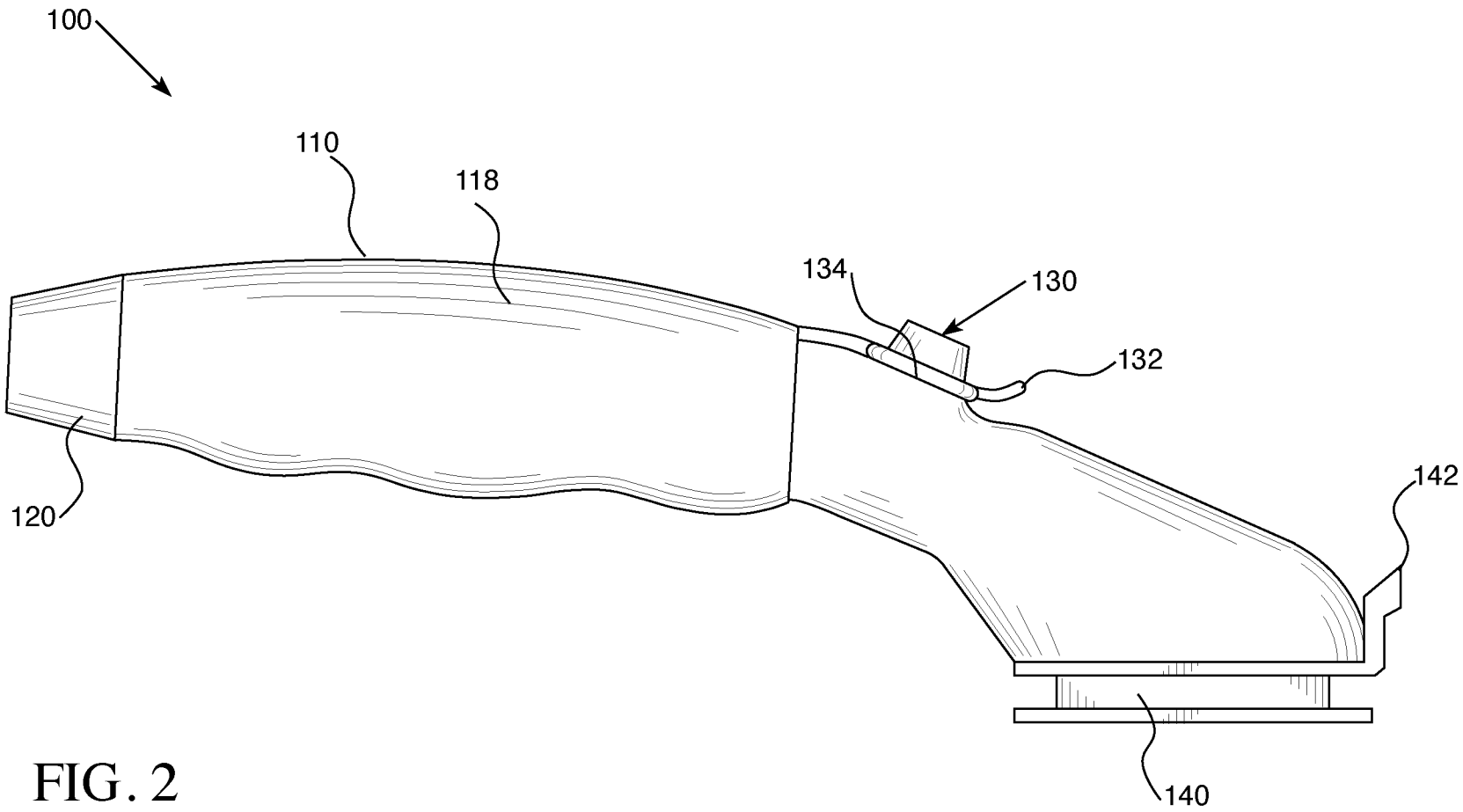
FIG. 2 is a right-side plan view of an embodiment of the current invention without a cleaning head secured to the footing.
Figure 4:
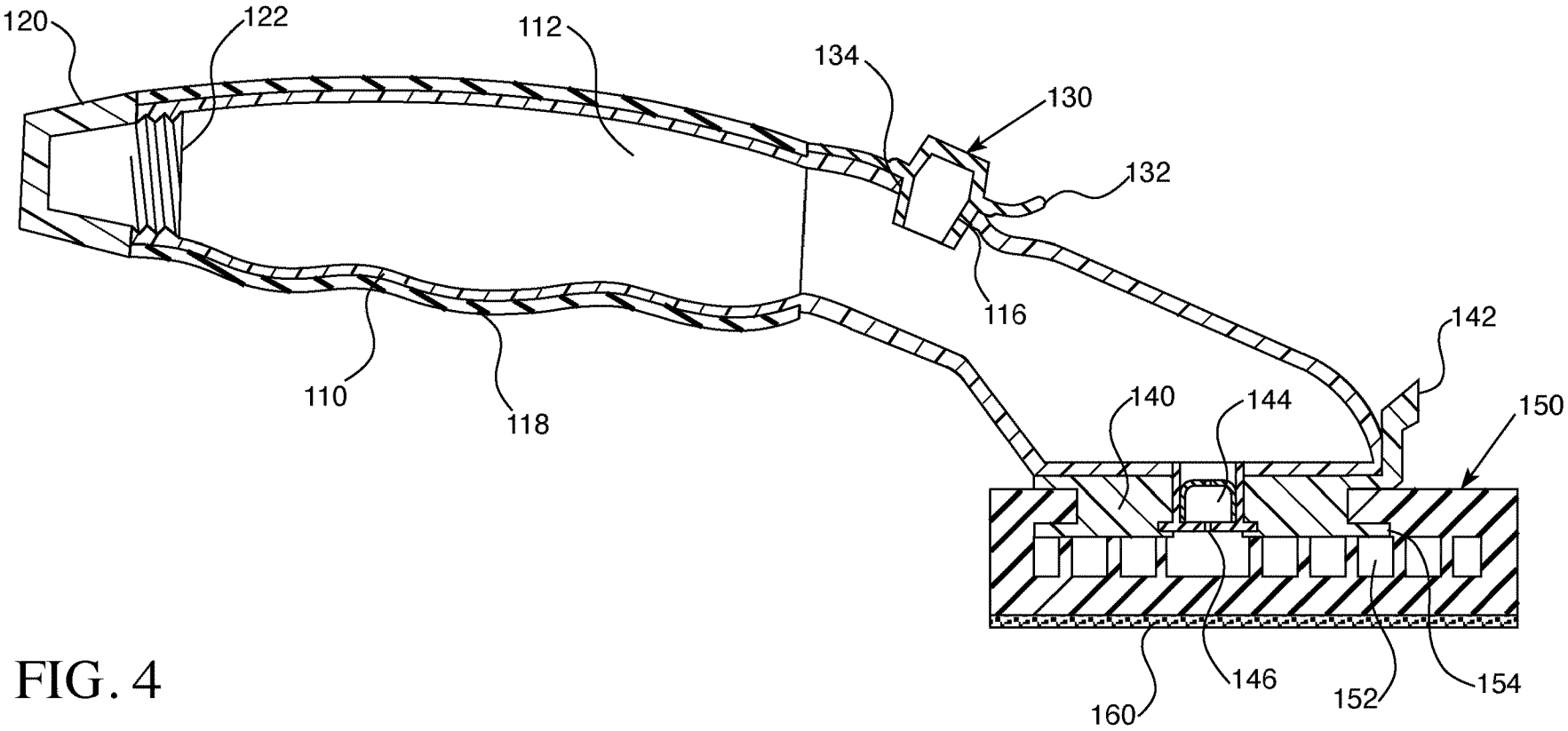
FIG. 4 is a cross-sectional view of the embodiment in FIG. 3.

The construction of the outer wall of the handle assembly 110 may be achieved with a variety of materials. Some embodiments may include a handle assembly 110 constructed with flexible materials, whereas other embodiments may include non-flexible materials; these materials a well-known by persons of skill within the art. The footing 140 may include an upper lip and a lower lip that may be defined by a depression disposed between the upper and lower ends of the footing 140. The upper lip can be disposed onto the handle assembly 110 in embodiments that have a footing that is not integral to the handle assembly 110. In embodiments where the footing is integral to the handle assemble 110, the upper lip may be the junction point between the footing 140 and the handle assemble 110. The depression may be included within the entire radius of the footing 140. An example of the depression and lower lip structures of a footing 140 is illustrated in FIG. 2. The lower lip may act as the connection between the cleaning head 150 and the footing 140, wherein an opening 154 within the upper portion of a cleaning head 150 can have a friction fit into the depression of the footing 140 allowing the lower lip of the footing 140 to secure the cleaning head 150 to the handle assembly 110. The cross-section illustrated in FIG. 4 shows such a connection, where the footing 140 and cleaning head 150 are joined, and the lower lip of the footing 140 is encased within the cleaning head 150. Such a secured connection may provide a user with the ability to compress the cleaning head 150, allowing for the generation of an emulsion of a cleaning fluid and water while allowing for the user to vigorously scrub an item with a cleaning head 150. At least one aperture 170 may be disposed within the sidewall, the upper portion, or the lower portion of a cleaning head 150. The aperture 170 may provide fluidic communication from the exterior of the cleaning head 150 to the interior, where a cleaning solution can mix with an external water source. Within the cleaning head 150, an emulsion may be created with compression of the cleaning head 150 by a user. Once an emulsion is created, it may be dispersed via aperture 170. The cleaning head 150 may include several apertures 170 spread throughout the sidewall, the upper portion, or the lower portion of the cleaning head 150.

The handle assembly 110 may include an end cap 120 at the distal end of the handle assembly 110. The end cap 120 can be attached to the distal end via threading 122. However, other means of attachment for the end cap 120 may be considered; for example, the distal end of handle assembly 110 may include a friction fit for the end cap 120. Other embodiments of the handle assembly 110 may not include an end cap. The handle assembly 110 may further include a rubber sleeve 118 covering the handle assembly 110 from the end cap 120 to the button 130 to assist with gripping by a user.

Disposed within the side of the handle assembly 110 may be a flexible button 130. The flexible button 130, in some embodiment, may be attached via a friction fit within an opening 116 within the outer surface of the handle assembly 110. This opening 116 may be an entry point for the introduction of a cleaning fluid into a reservoir 112 within the handle assembly 110, as illustrated in the cross-sectional view of FIG. 4. To assist the removal of the flexible button 130 from the opening 116, a release tab 132 may be disposed on the proximal side of the flexible button 130. In some embodiments, the release tab 132 may be an integral portion of the flexible button 130. In other embodiments, a release tab 132 may not be included. Further, flexible button 130 may include a void 134 for the production of increased air pressure within reservoir 112.

The cleaning head 150 may include a scrubbing surface 160 that can be disposed on the bottom portion of the cleaning head 150. The scrubbing surface 160 can be derived from thermoplastics, elastomers, or any combination thereof. The scrubbing surface 160 may be disposed on the bottom of the cleaning head 150 in some embodiments. Other embodiments of the cleaning head 150 with a scrubbing surface 160 may include a scrubbing surface 160 that is partially integrated within the bottom surface of the cleaning head 150, or the scrubbing surface 160 may be semi-flush or flush with the bottom surface of the cleaning head 150.

A scrubbing surface 160 of a cleaning head 150 in some embodiments may be embedded with an abrasive to enhance the cleaning ability of that particular embodiment. Such abrasive may be any of the following materials: rottenstone, tripoli, whiting, pumice, volcanic ash, quartz, marble, feldspar, silica, steel wool, walnut shells, calcium carbonate, aluminum carbide, garnet, sand, iron oxide, emery, diamond dust, sandstone, staurolite, tungsten, corundum, silicon carbide, borazon, ceramic, ceramic aluminum oxide, ceramic iron oxide, aluminum oxide, glass powder, zirconia alumina, boron carbide, slags, zirconium, thermoplastic polymers, copper, and stainless steel these abrasives may be used alone or in any combination.

The cleaning head 150 may be comprised of multiple layers of flexible non-porous material, wherein the body is the first layer, and an opening 154 in the upper portion of the cleaning head 150 defines a rim of flexible non-porous material that can secure the cleaning head 150 to the footing 140. An additional layer of flexible non-porous material may be included, wherein the additional layer can be overmolded or bonded to the cleaning head 150 to form a scrubbing surface 160. The scrubbing surface 160 can be made of a harder flexible non-porous material other than the material used to construct the body of the cleaning head 150. Such construction may allow the cleaning head 150 to be rigid enough to scrub and flexible enough to contour to different parts of the surface in need of scrubbing. The cleaning head 150 can be made of a flexible non-porous material that is able to withstand the sanitization provided by a dishwasher after every use.

The bonding of material onto the cleaning head 150 can be achieved with a chemical bond by use of multiple shore hardness of flexible non-porous material; this may provide a very strong connection between the two different materials. Other bonding techniques may also be employed to combine multiple layers of non-porous materials into a cleaning head 150. The cleaning head 150 can contain a female connection defined by the opening 154, which may be from a combination with a male connection defined by the lower lip of the footing 140. Such a direct connection may only be possible because of the characteristics of the flexible non-porous materials being rigid enough to hold this connection but flexible enough to insert the opening 154 around the lower lip of the footing 140.

Further in FIG. 1 is an example of a wedge scrubber 142 that may be disposed on the front portion of the upper area of a footing 140. The wedge scrubber 142 can be integral to the footing 140. Both the footing 140 and the wedge scrubber 142 may be constructed of the same material as the handle assembly 110, or they may be constructed with a number of other non-flexible materials well known in the art. The wedged scrubber 142 may provide a surface to apply significant pressure to an object being cleaned that may include a substance that cannot be displaced by scrubbing with the cleaning head 150. In further embodiments, the wedge scrubber may be disposed on the cleaning head itself and not the footing.

Figure 3:
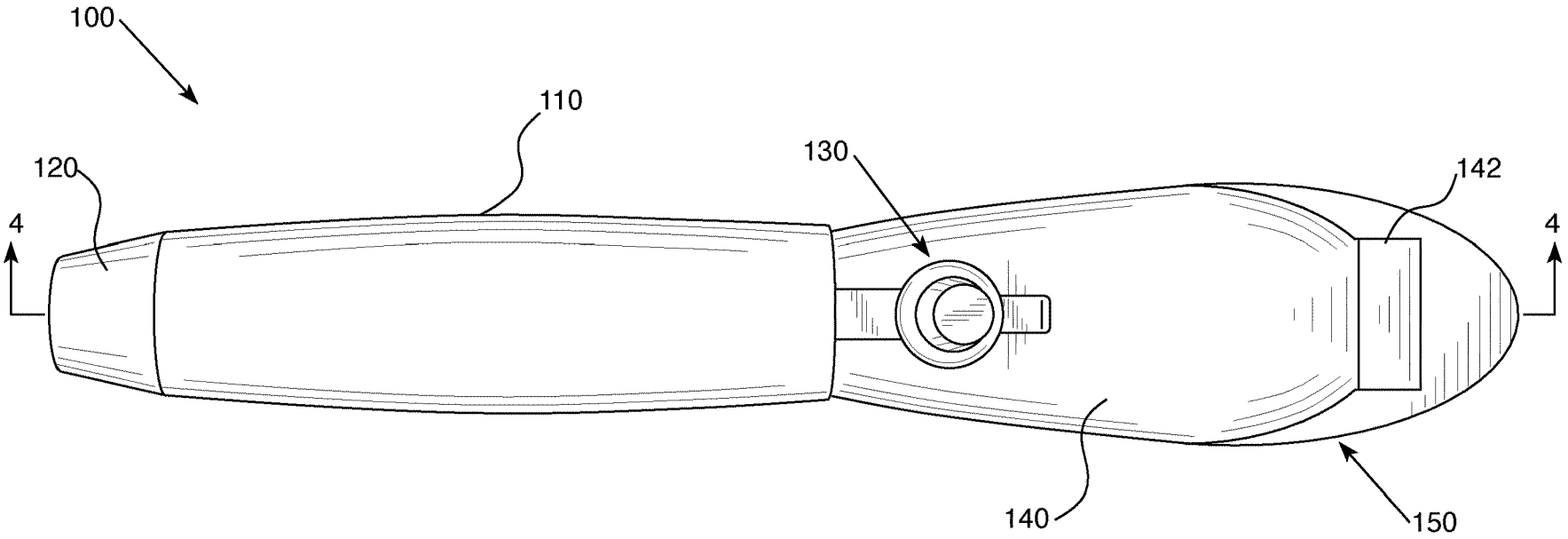
FIG. 3 is a top view of an embodiment of the current invention with a cleaning head secured to the footing.

Regarding FIG. 3, a top view illustration of an embodiment of the present concept illustrates a wedge scrubber 142 where it can be located above the top surface of a cleaning head 150. The width and length of a wedge scrubber 142 may vary depending on the desire of the end-user and the application of a flexible cleaner 100. Included in FIG. 3 is cross-section line 4 providing the illustration reference for FIG. 4. This wedge scrubber 142 may have a non-abrasive material used to scrub off tough/caked-on foods. The wedge scrubber 142 may also contain a pointed edge that is upward-pointing respective to the top side of handle assembly 110. A user may flip the handle assembly 110 upsides down, positioning the cleaning head 150 away from a surface needing to be scrubbed so the user can apply force from the wedge scrubber 142 to the surface in need of cleaning.

Within FIG. 4. is an illustration of a series of cavities that may be within the cleaning head 150. Some of the cavities may be emulsion cavities 152 which can be in fluidic communication with reservoir 112 via a dispensing port 144 and a one-way valve 146 disposed between the dispensing port 144 and the emulsion cavities. The dispensing port 144 may be non-destructively removable for the alternative purpose of loading a cleaning fluid into the reservoir 112.

Other cavities within cleaning head 150 may not be in fluidic communication. These non-communicative cavities may be accessible when the cleaning head is removed from the footing and sealed off when the cleaning head is disposed on the footing to limit direct fluidic contact during a washing process. In the embodiment of FIG. 4, the emulsion cavities 152 are in a frame-like configuration comprising a series of similarly shaped depressions. Other embodiments of the emulsion cavities 152 may include non-symmetrical depressions that conform to the exterior shape of the cleaning head 150. The emulsion cavities 152 may also be in fluidic communication with an exterior water source via aperture 170.

Figure 5:
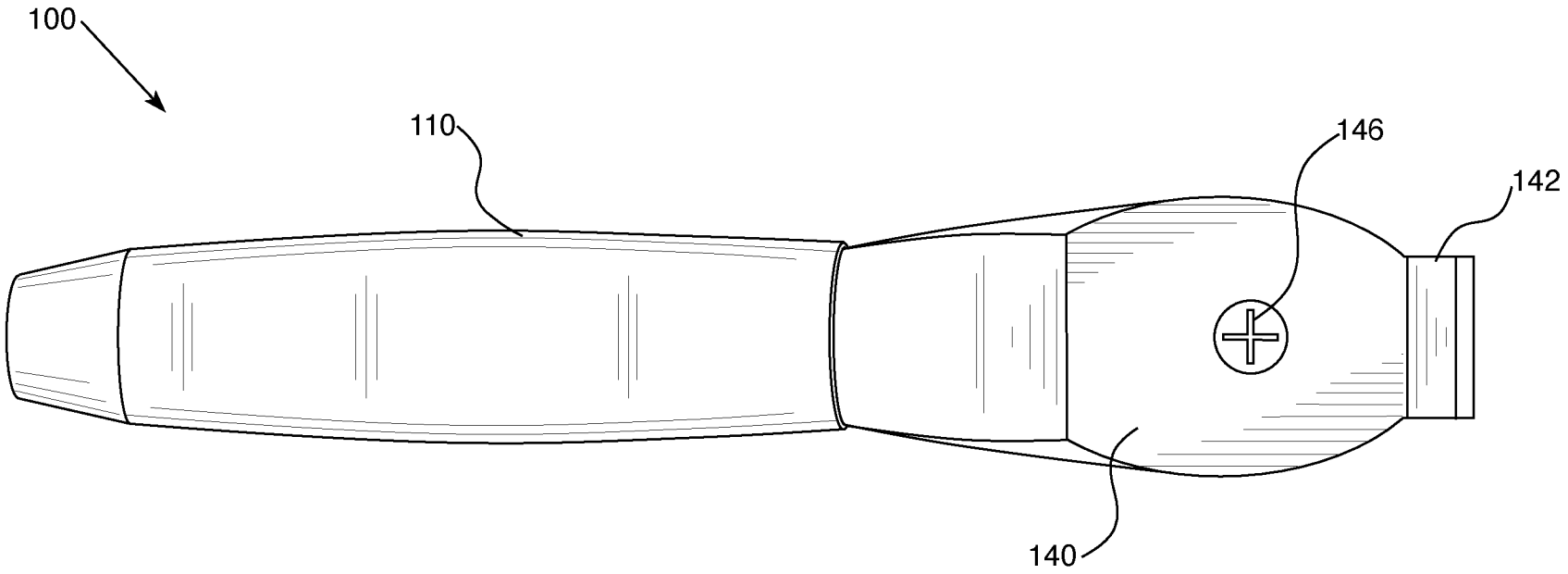
FIG. 5 is a bottom plan view of an embodiment of the current invention without a cleaning head secured to the footing.

The one-way valve 146 may be included in some embodiments of the flexible cleaner 100, and other embodiments may only require a dispensing port 144 to have fluidic communication with the emulsion cavities 152. As illustrated in FIG. 5, the one-way valve 146 may consist of a cross-hatch opening that can provide a cleaning solution within reservoir 112 to flow into the emulsion cavities 152. The flow from the reservoir 112 into the emulsion cavities 152 can be induced by a user when they depress button 130 into the interior of the handle assembly 110 through the opening 116, causing an increase in air pressure within the reservoir 112 that is equalized by the release of cleaning fluid through the one-way valve 146.

Figure 6:
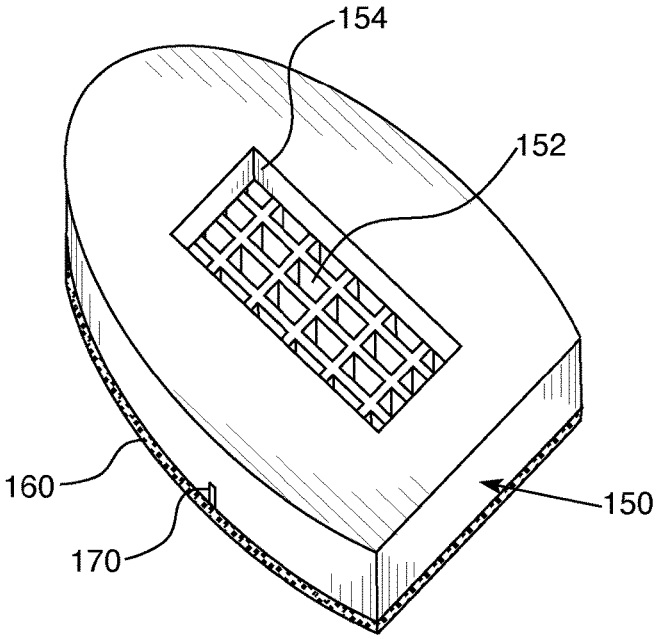
FIG. 6 is a top perspective view of a cleaning head of an embodiment of the current invention.
Figure 7:
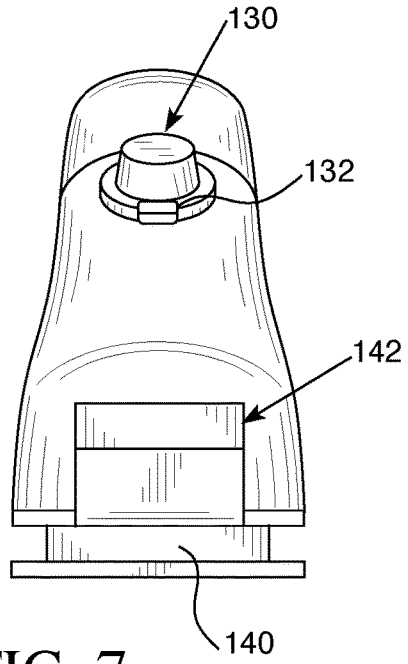
FIG. 7 is a front view of an embodiment of the current invention without a cleaning head secured to the footing.

Regarding FIG. 6, this is an illustration of the top view of an embodiment of a cleaning head 150 showing the top surface. Within the upper portion of the cleaning head 150 can be an opening 154, which can form a rim that may encompass the entire permitter of the opening 154, which may be structured and configured to fit within the depression of the footing 140, illustrated in FIG. 7, that is defined by the lower lip of the footing 140. The opening 154 may allow access to the cavities therein. In other embodiments, the cavities may include a covering that is a full or partial layer of flexible non porous material which can be flush with the base of the footing; this covering may act as barrier to some of the cavities to prevent the intrusion of debris.

Within the interior of the cleaning head 150 can be an emulsion cavity 152, which is at least partially spaced apart from the rim defined by the opening 154. Such spacing between the rim defined by the opening 154 and the emulsion cavity 152 may provide an area for the footing 140 to connect to the cleaning head 150, and it may allow fluidic communication between the individual depressions of the emulsion cavity 152. The fluidic communication may also occur between the emulsion cavity 152 and the aperture 170 disposed through the cleaning head 150. A cleaning head 150 may be compressed by a user to perform several actions, including the production on an emulsion within the emulsion cavity 152 in the presence of a cleaning fluid and a source of water, and further, where compression by a user may also allow the aperture 170 to expand thereby releasing a created emulsion from the emulsion cavity 152 to the exterior for use in cleaning a surface.

Figure 8:
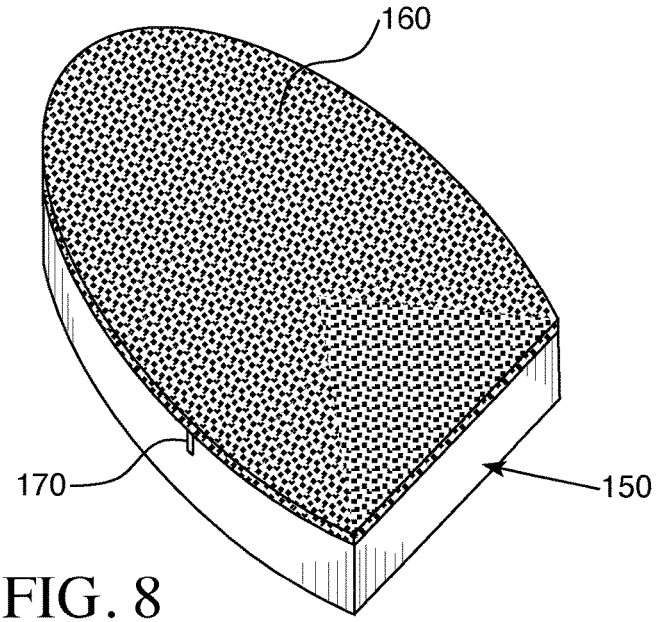
FIG. 8 is a bottom perspective view of a cleaning head of an embodiment of the current invention.

The cleaning head embodiment illustrated in FIGS. 6 and 8 may include sidewalls that can be nearly perpendicular to the upper and lower portions of the cleaning head. Other embodiments may include sidewalls that are comprised of a multitude of convex shapes, convex polygons, concave shapes, and concave polygons. These other shapes for the sidewalls of a cleaning head 150 may also include a cross between outside and inside in respect to the vertical plane of the scrubbing surface 160.

Figure 9:
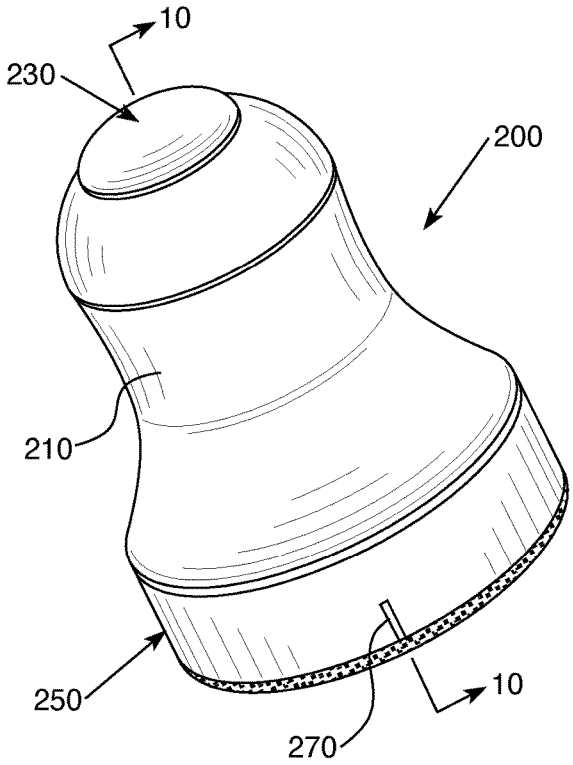
FIG. 9 is a perspective view of an alternative embodiment of the current invention with a cleaning head secured to the footing.

Regarding FIG. 9, an alternative embodiment of a flexible cleaner 200 is illustrated where the handle assembly 210 is structured and configured to fit within a user's palm; the outer wall of the handle assembly 210 may be achieved with a variety of materials. This embodiment may include a button 230 that is disposed within the proximal end of an end-cap 220. The end-cap 220 may be connected to the handle assembly 210 via threading 222. The handle assembly 210 may include a footing 250, illustrated in FIG. 10, that can connect to cleaning head 250. The cleaning head 250 may also include at least one, but may have several, aperture 270; wherein the aperture 270 can be in fluidic communication with emulsion cavity 252 and may be disposed within the sidewall, the upper portion, or the lower portion of a cleaning head 250. The reservoir may be filled with a cleaning solution by removing the end-cap 220, then loading the reservoir 212 with a cleaning solution followed by the reinstallation of the end-cap 220.

Figure 10:
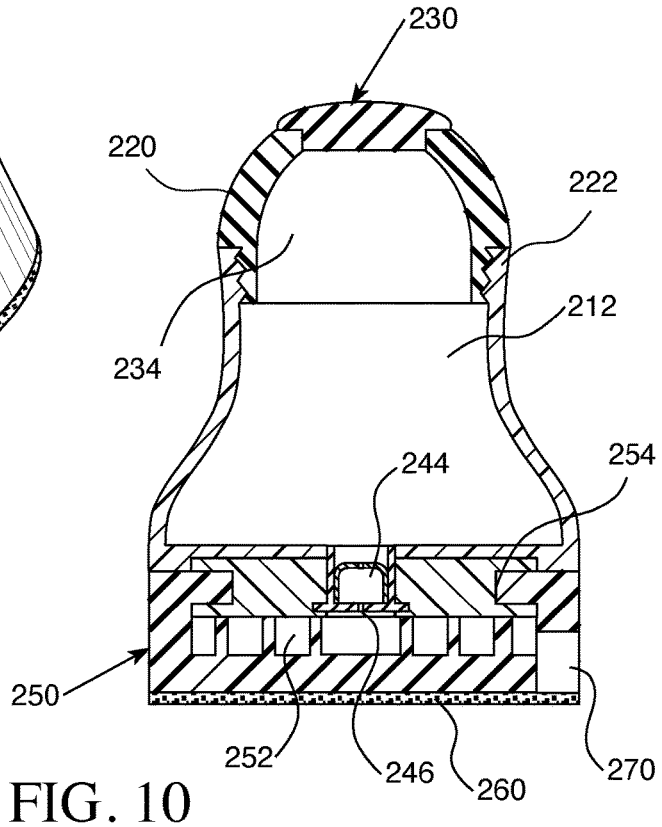
FIG. 10 is a cross-sectional view of the embodiment in FIG. 9.

As illustrated in the cross-section of FIG. 10, the handle assembly 210 may also include a reservoir 212 that is in fluidic communication with the emulsion cavity 252 via the dispensing port 244 and one-way valve 246. The dispensing port 244 may be non-destructively removable for the alternative purpose of loading a cleaning fluid into the reservoir 212. Other embodiments may not include both dispensing port 244 and one-way valve 246; in such embodiments, there may only be one of either the dispensing port 244 or the one-way valve 246. Just as with the first described embodiment, the flexible cleaner 200 can be compressed by a user, which may, in turn, depress the button 230 causing a cleaning fluid in the reservoir 212 to flow into the emulsion cavity 252. Further compression to the flexible cleaner 200, in the presence of an external water source, may produce an emulsion of the cleaning fluid and that water by allowing the water to be in fluidic communication with the emulsion cavity 252 via the aperture 270.

Figure 11:
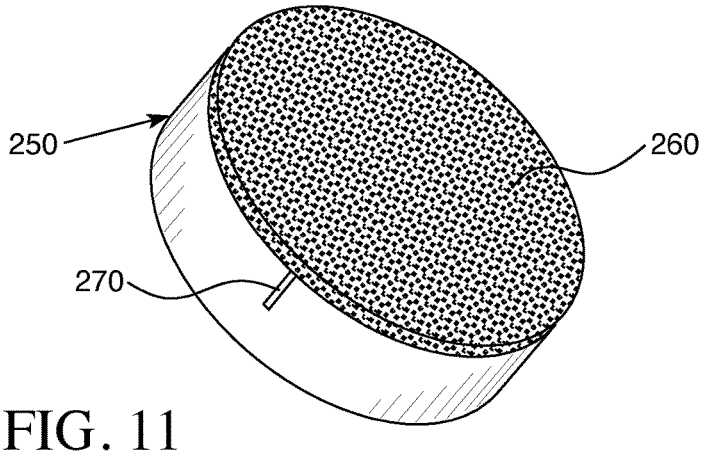
FIG. 11 is a bottom perspective view of an alternative cleaning head embodiment of the current invention.

The cleaning head 250 embodiment, illustrated in FIGS. 9-11 may include sidewalls that can be nearly perpendicular to the upper and lower portions of the cleaning head. Other embodiments may include sidewalls that are a multitude of convex shapes, convex polygons, concave shapes, and concave polygons. These other shapes for the sidewalls of a cleaning head 250 may also include a cross between outside and inside in respect to the vertical plane of the scrubbing surface 260.

The cleaning head 250 may include a scrubbing surface 260 that can be disposed on the bottom portion of the cleaning head 250. The scrubbing surface 260 can be derived from thermoplastics, elastomers, or any combination thereof. The scrubbing surface 260 may be disposed on the bottom of the cleaning head 250 in some embodiments. Other embodiments of the cleaning head 250 with a scrubbing surface 260 may include a scrubbing surface 260 that is partially integrated within the bottom surface of the cleaning head 250, or the scrubbing surface 260 may be semi-flush or flush with the bottom surface of the cleaning head 250.

A scrubbing surface 260 of a cleaning head 250 in some embodiments may be embedded with an abrasive to enhance the cleaning ability of that particular embodiment. Such abrasive may be any of the following materials: rottenstone, tripoli, whiting, pumice, volcanic ash, quartz, marble, feldspar, silica, steel wool, walnut shells, calcium carbonate, aluminum carbide, garnet, sand, iron oxide, emery, diamond dust, sandstone, staurolite, tungsten, corundum, silicon carbide, borazon, ceramic, ceramic aluminum oxide, ceramic iron oxide, aluminum oxide, glass powder, zirconia alumina, boron carbide, slags, zirconium, thermoplastic polymers, copper, and stainless steel these abrasives may be used alone or in any combination.

The cleaning head 250 may be comprised of multiple layers of flexible non-porous material, wherein the body is the first layer, and an opening 254 in the upper portion of the cleaning head 250 defines a rim of flexible non-porous material that can secure the cleaning head 250 to the footing 240. An additional layer of flexible non-porous material may be included, wherein the additional layer can be overmolded or bonded to the cleaning head 250 to form a scrubbing surface 260. The scrubbing surface 260 can be made of a harder flexible non-porous material other than the material used to construct the body of the cleaning head 250. Such construction may allow the cleaning head 250 to be rigid enough to scrub and flexible enough to contour to different parts of the surface in need of scrubbing. The cleaning head 250 can be made of a flexible non-porous material that is able to withstand the sanitization provided by a dishwasher after every use.

The bonding of material onto the cleaning head 250 can be achieved with a chemical bond by use of multiple shore hardness of flexible non-porous material; this may provide a very strong connection between the multiple materials. Other bonding techniques may also be employed to combine multiple layers of non-porous materials into a cleaning head 250. The cleaning head 250 can contain a female connection defined by the opening 254, which may form a combination with a male connection defined by the lower lip of the footing 240. Such a direct connection may only be possible because of the characteristics of the flexible non-porous materials being rigid enough to hold this connection but flexible enough to insert the opening 254 around the lower lip of the footing 240.

The flexible cleaner may be used to remove dirt and debris from surfaces. For example, a flexible cleaner can be used to remove food from dirty dishware. This may be accomplished by filling a reservoir with a miscible cleaning fluid, for example, a liquid dish detergent. The miscible cleaning fluid may be dispensed into an emulsion cavity of a cleaning head by a user, where the user depresses the button, thereby forcing the miscible cleaning fluid into the emulsion cavity. The cleaning head of the flexible cleaner, once the emulsion cavity is filled with the miscible cleaning fluid, may then be introduced to an external source of water; for example, a water filed kitchen sink containing dirty dishware. Once the cleaning head is introduced to the external source of water, the user may compress the cleaning head onto a surface repeatedly to create an emulsion within the emulsion cavity by forcing the water in and out of the emulsion cavity through an aperture within the cleaning head. Once an emulsion is formed, then the cleaning head may be applied and compressed onto the unclean surface along with the emulsion to scrub away the dirt and debris. Once the scrubbing is completed, the cleaning head may be removed from the footing of the handle assembly. The cleaning head may then be subjected to a sanitation process to remove bacterial build-up and debris; for example, the cleaning head may be placed in a dishwasher or into a bleach solution. Further, the cleaning head may be manually cleared of any acquired build-up that could be disposed within the confines of the emulsion cavity, sidewall, and upper and lower portions; i.e., the whole of the cleaning head.

Figure 12:
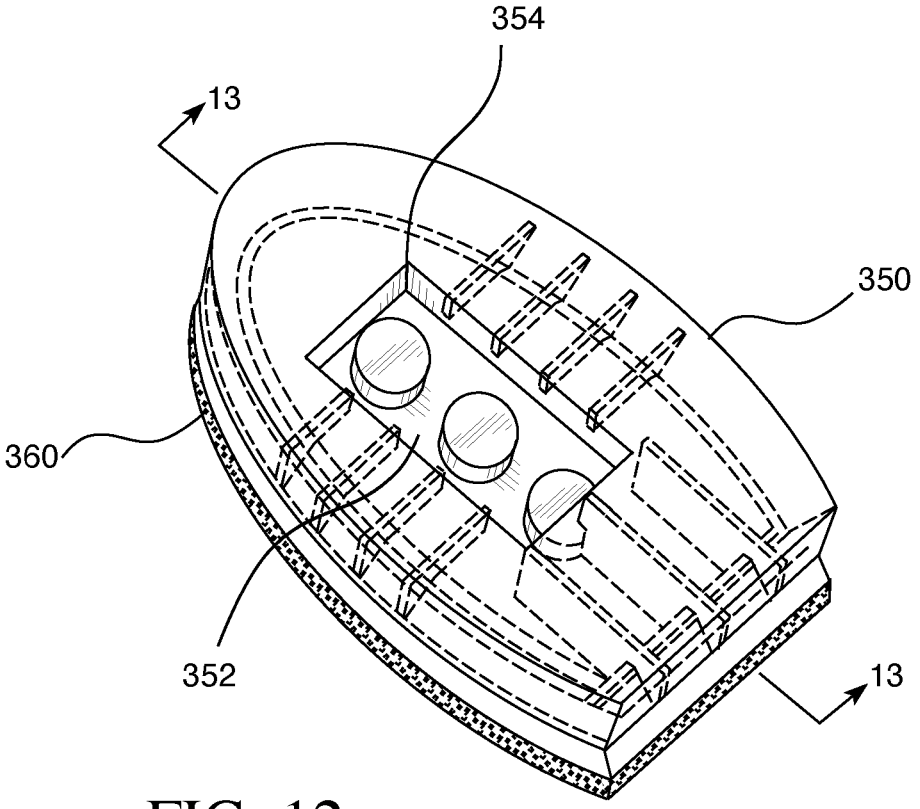
FIG. 12 is a perspective view of a further cleaning head embodiment of the current invention.
Figure 13:
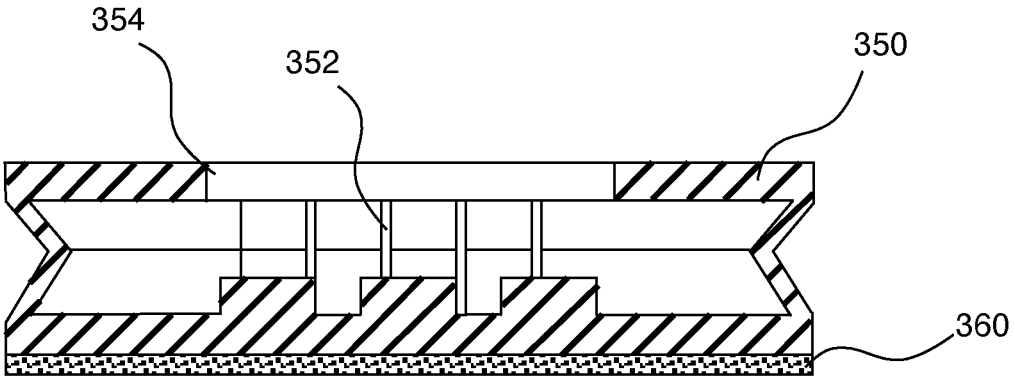
FIG. 13 is a cross-section view of the embodiment of FIG. 12.

Other embodiments of the cleaning head may increase the amount of multi-variable compression that can be applied by a user onto an unclean surface, or allow a user more access to surfaces that have non-uniform shapes. As illustrated in FIGS. 12 and 13, another embodiment of a cleaning head 350 may include a sidewall where other non-linear shapes may be provided. As illustrated in cleaning head 350, the sidewall is a "V" shape. Other embodiments may include sidewalls that are a multitude of convex shapes, convex polygons, concave shapes, and concave polygons. These other shapes for the sidewalls of a cleaning head 350 may also include a cross between outside and inside in respect to the vertical plane of the scrubbing surface 360. Such sidewall and internal structure configurations may provide greater multi-variable compression and responsiveness of the cleaning head 350 for both the formation of an emulsion within the emulsion cavity 352 and the ability for the cleaning head 350 to gain access to non-uniform surfaces that need cleaning and scrubbing. The cleaning head 350, of FIGS. 12 and 13 may also include an opening 354 that forms a rim that allows for the attachment of the cleaning head 350 to a handle assembly (not shown). Such configurations of the sidewalls may be included in any embodiment of a cleaning head.

Persons of ordinary skill in arts relevant to this disclosure and subject matter hereof will recognize that embodiments may comprise fewer features than illustrated in any individual embodiment described by example or otherwise contemplated herein. Embodiments described herein are not meant to be an exhaustive presentation of ways in which various features may be combined and/or arranged. Accordingly, the embodiments are not mutually exclusive combinations of features; rather, embodiments can comprise a combination of different individual features selected from different individual embodiments, as understood by persons of ordinary skill in the relevant arts. Moreover, elements described with respect to one embodiment can be implemented in other embodiments even when not described in such embodiments unless otherwise noted. Although a dependent claim may refer in the claims to a specific combination with one or more other claims, other embodiments can also include a combination of the dependent claim with the subject matter of each other dependent claim or a combination of one or more features with other dependent or independent claims. Such combinations are proposed herein unless it is stated that a specific combination is not intended. Furthermore, it is also intended to include features of a claim in any other independent claim, even if this claim is not directly made dependent on the independent claim.

The invention claimed is:

1. A flexible cleaner comprising:

a handle assembly, wherein the handle assembly comprises:

an outer wall, wherein the outer wall has a distal end and a proximal end, a liquid storage reservoir defined by an interior of the outer wall, wherein the liquid storage reservoir is structured and configured a miscible cleaning fluid, a button, wherein the button is disposed within the outer wall, a dispensing port, a footing having a central depression, wherein the depression defines an upper lip and a lower lip, wherein the upper lip is disposed on the distal end of the outer wall; and a cleaning head, wherein the cleaning head comprises:

a body wherein the body is comprised of a flexible non-porous material, the body having an upper portion, a lower portion, and a sidewall, an opening in the upper portion structured and configured to connect to the lower lip of the footing, and at least one aperture, wherein the at least one aperture is in fluidic communication with an area exterior of the cleaning head, and an emulsion cavity disposed between the upper portion and the lower portion within the body, wherein the emulsion cavity is in fluidic communication with the reservoir and the aperture.

2. The flexible cleaner of claim 1, wherein the flexible non-porous material is selected from the group consisting of silicone, rubber, synthetic polyisoprene, polyurethane, nitrile, natural latex rubber, and thermoplastic elastomers and polymers, or any combination thereof.

3. The flexible cleaner of claim 2, wherein a scrubbing surface is disposed onto the lower portion of the body, the scrubbing surface having at least one layer of scrubbing material.

4. The flexible cleaner of claim 3, wherein the sidewall comprises a shape, with respect to the upper portion and lower portion of the body, is selected from the group consisting of convex, concave, convex polygons, concave polygons, and perpendicular or any combination thereof.

5. The flexible cleaner of claim 4, wherein an end-cap is disposed on the proximal end of the outer wall, wherein the proximal end of the outer wall is threaded and the end-cap is threaded.

6. The flexible cleaner of claim 5, wherein the dispensing port includes a one-way valve, wherein the one-way valve is in fluidic communication with the emulsion cavity and the reservoir.

7. The flexible cleaner of claim 6, wherein a scrubbing wedge is disposed on the upper lip.

8. The flexible cleaner of claim 6, wherein the flexible non-porous material scrubbing surface further comprises at least one additional layer of flexible non-porous material over-molded surface.

9. The flexible cleaner of claim 4, wherein the at least one layer of scrubbing material is selected from the group consisting of rottenstone, tripoli, whiting, pumice, volcanic ash, quartz, marble, feldspar, silica, steel wool, walnut shells, calcium carbonate, aluminum carbide, garnet, sand, iron oxide, emery, diamond dust, sandstone, staurolite, tungsten, corundum, silicon carbide, borazon, ceramic, ceramic aluminum oxide, ceramic iron oxide, aluminum oxide, glass powder, zirconia alumina, boron carbide, slags, zirconium, thermoplastic polymers, copper, and stainless steel or any combination thereof.

10. The flexible cleaner of claim 4, wherein the outer wall comprises an exterior surface coating of rubber or silicone, wherein the exterior surface coating partially covers the outer wall.

11. The flexible cleaner of claim 4, wherein the flexible non-porous material scrubbing surface comprises a plurality of geometric formations disposed on the surface of the flexible non-porous material scrubbing surface.

12. The flexible cleaner of claim 1, further comprising a first miscible cleaning fluid within the liquid storage reservoir.

13. The flexible cleaner of claim 1, further comprising an emulsion within the emulsion cavity, wherein the emulsion comprises a first miscible cleaning fluid and water.

14. A method of using a flexible cleaner comprising:

supplying a flexible cleaning device comprising:

a handle assembly, wherein the handle assembly comprises:

an outer wall, wherein the outer wall has a distal end and a proximal end, a liquid storage reservoir defined by an interior of the outer wall, a button, wherein the button is disposed within the outer wall, a dispensing port, a footing having a central depression, wherein the depression defines an upper lip and a lower lip, wherein the upper lip is disposed on the distal end of the outer wall; and a cleaning head, wherein the cleaning head comprises:

a body wherein the body is comprised of a flexible non-porous material, the body having an upper portion, a lower portion, and a sidewall, an opening in the upper portion structured and configured to connect to the lower lip of the footing, and at least one aperture, wherein the at least one aperture is in fluidic communication with an exterior area of the cleaning head, an emulsion cavity disposed between the upper portion and lower portion within the body, wherein the emulsion cavity is in fluidic communication with the reservoir and the aperture;

filling the reservoir with a miscible cleaning fluid;

depressing the button to increase an internal pressure within the reservoir, thereby forcing the miscible cleaning fluid through the dispensing port into the emulsion cavity;

introducing the cleaning head to an external water source;

applying pressure to the cleaning head repeatedly, thereby forcing water through the aperture into the emulsion cavity;

forming an emulsion with the miscible cleaning fluid and the water within the emulsion cavity;

introducing the cleaning head onto an unclean surface;

applying pressure to the cleaning head repeatedly, thereby forcing the emulsion onto the unclean surface; and scrubbing the unclean surface with the cleaning head.

15. The method of claim 14 wherein the flexible cleaning device further comprises the flexible non-porous material to be selected from the group consisting of silicone, rubber, synthetic polyisoprene, polyurethane, nitrile, natural latex rubber, and thermoplastic elastomers and polymers, or any combination thereof.

16. The method of claim 15, wherein the flexible cleaning device further comprises a scrubbing surface disposed onto the lower portion of the body, the scrubbing surface having at least one layer of scrubbing material.

17. The method of claim 16, wherein the flexible cleaning device further comprises the sidewall having a shape, with respect to the upper portion and lower portion of the body, is selected from the group consisting of convex, concave, convex polygons, concave polygons, and perpendicular or any combination thereof.

18. The method of claim 17, wherein the flexible cleaning device further comprises an end-cap disposed on the proximal end of the outer wall, wherein the proximal end of the outer wall is threaded and the end-cap is threaded.

19. The method of claim 18, wherein the flexible cleaning device further comprises the dispensing port having a one-way valve, wherein the one-way valve is in fluidic communication with the emulsion cavity and the reservoir.

20. The method of claim 18 comprising the further steps of removing the cleaning head from the footing and subjecting the cleaning head to a sanitizer.

* * * * *